US006024613A

United States Patent [19]

Mashiyama et al.

[11] Patent Number: 6,024,613

[45] Date of Patent: Feb. 15, 2000

[54] SOCKET CONTACT AND METHOD FOR PRODUCING THE SAME

[75] Inventors: Jin-ichi Mashiyama; Yukio Saitoh, both of Tokyo, Japan

[73] Assignee: DDK, Ltd., Tokyo, Japan

[21] Appl. No.: 09/182,614

[22] Filed: Oct. 29, 1998

[30] Foreign Application Priority Data

Oct. 31, 1997 [JP] Japan ..... 9-316228

[51] Int. Cl.[7] ..... H01R 13/11

[52] U.S. Cl. ..... 439/857; 439/851

[58] Field of Search ..... 439/857, 856, 439/842, 851, 852

[56] References Cited

U.S. PATENT DOCUMENTS

| | | | |
|---|---|---|---|
| 4,241,970 | 12/1980 | Rider et al. | 439/856 |
| 4,552,425 | 11/1985 | Billman | 439/842 |
| 4,647,134 | 3/1987 | Nonaka | 439/851 |
| 4,743,208 | 5/1988 | Weisenburger | 439/857 |
| 4,907,990 | 3/1990 | Bertho et al. | 439/851 |
| 5,151,056 | 9/1992 | McClure | 439/851 |
| 5,194,022 | 3/1993 | Enomoto | 439/856 |
| 5,334,053 | 8/1994 | Noschese | 439/857 |
| 5,435,757 | 7/1995 | Fedder et al. | 439/857 |
| 5,766,045 | 6/1998 | Sawaki et al. | 439/857 |
| 5,888,096 | 3/1999 | Soes et al. | 439/857 |
| 5,908,335 | 6/1999 | Satoh | 439/857 |

*Primary Examiner*—Paula Bradley
*Assistant Examiner*—Tho D. Ta
*Attorney, Agent, or Firm*—Baker & Botts, L.L.P.

[57] ABSTRACT

A socket contact includes a connection portion, a fixing portion, contact portions and connecting portions for connecting the contact portions to the fixing portion. The center axis of the contact portions are shifted from the fixing portion by bending the connecting portions in their planes. In producing the socket contact, a blank material is punched to form a flat socket contact whose two contact pieces arranged in parallel with each other are then bent inwardly to form a U-shaped form. Thereafter, connecting portions of the two contact pieces are bent in the planes of the connecting portions. This socket contact fulfills the requirement with respect to the miniaturization of connectors with very narrow pitches. There is no longer any risk of the distal end of a mating contact contacting the bottom surface of the fixing portion of the socket contact, so that the assembling of the connector becomes easy and the stable contact between the socket and mating contacts can be obtained.

3 Claims, 5 Drawing Sheets

SOCKET CONTACT AND METHOD FOR PRODUCING THE SAME

BACKGROUND OF THE INVENTION

This invention relates to a socket contact for use in a female connector of paired electrical connectors used in an electronic appliances for connection between two boards, and more particularly to a method for producing such a socket contact.

A hitherto used socket contact will be explained by referring to FIGS. 4A and 4B and 5A and 5B. FIG. 4A illustrates in a perspective view an electrical connector 40 using socket contacts 42 of the prior art. FIG. 4B is a perspective view showing the socket contact 42 of the prior art. FIG. 5A illustrates in a side view the socket contact 42 of the prior art with a mating contact 22 shown in imaginary lines inserted therein. FIG. 5B is a side view of a socket contact 421 which is a modification of the socket contact 42 to have a narrower pitch of socket contacts and a mating contact 22 in imaginary lines inserted therein.

In general, the electrical connector 40 mainly consists of an insulator 12 and socket contacts 42 or 421 as well-known. The insulator 12 is an electrically insulating plastic material and formed by the well-known injection molding technique or the like. The socket contact 42 or 421 is made of a metal and formed by the well-known press working or the like.

The socket contact 42 or 421 consists of four portions, that is, contact portions 18 to contact a mating contact 22, a fixing portion 16 to be fixed to an insulator 12, a connection portion 14 to be connected to a board or the like (not shown) and connecting portions 20 for respectively connecting the contact portions 18 to the fixing portion 16. The contact portions 18, connecting portions 20, fixing portion 16 and connection portion 14 are arranged in this order. The contact portions 18, connecting portions 20 and fixing portion 16 are referred to as contact pieces 19.

In producing the socket contact 42 of the prior art shown in FIG. 4B, first a metal plate strip is punched to form a flat socket contact whose two contact pieces 19 arranged in parallel with each other are then bent inwardly into a U-shaped form.

In the state that such processes have been completed, the center axis of the contact portions 18 adapted to contact the mating contact 22 is shifted from the bottom surface 15 of the fixing portion 16 in consideration of the radius of the mating contact 22 plus the required clearance, thereby preventing the distal end of the mating contact 22 from contacting the bottom surface 15 of the fixing portion 16 as shown in FIG. 5A.

In order to shift the center axis of the contact portions 18 from the bottom surface 15 of the fixing portion 16 by a value corresponding to the radius of the mating contact 22 plus the required clearance, a pitch of socket contacts is required to be more than 2 mm, these socket contacts being continuous with each other in the state immediately after a metal plate strip is punched to form a series of flat socket contacts. In other words, according to the prior art the width (refer to numeral 17 in FIG. 2A) of the contact portions of the flat socket contact, which have not been bent, is required to be more than 2 mm in order to prevent the distal end of the mating contact from contacting the bottom surface of the fixing portion.

In assembling a connector by inserting socket contacts into an insulator, it has been a common practice to temporarily manually insert the continuous socket contacts 42 into a series of insertion apertures (not shown) formed in the insulator 12 and then to finally insert the separated socket contacts into the insulator 12 by means of a jig (not shown).

With the recent miniaturization of electrical (electronic) appliances, electrical connectors have been strongly required to be more miniaturized. In order to more miniaturize the electrical connectors, it is absolutely necessary to make the pitch of contacts as small as possible. With the contacts having such a construction and assembled in the manner described above, however, it is impossible to make a series of socket contacts having a pitch less than 2 mm, which is a problem to be solved.

If socket contacts were separately inserted into the insulator 12 one by one, a more miniaturized electrical connector could be obtained even if the continuous socket contacts in the state punched from a metal strip do not have a pitch less than 2 mm. However, such an assembling will increase the material cost and man-hour with resulting high production cost.

Moreover, even if a miniaturized electrical connector easy to assembly can be obtained with a smaller pitch of socket contacts fulfilling the requirement of the recent market, there would be tendency of the distal end of the mating contact 22 to contact the bottom surface 15 of the fixing portion 16 of the socket contact, which is a further problem to be solved. Such contact between the mating contact and the bottom surface of the fixing portion of the socket contact will cause the damage of both the contacts, resulting into defective contact therebetween and, in worst cases, requiring the replacement of the male and female connectors or boards. Such a replacement will increase the production cost.

SUMMARY OF THE INVENTION

It is an object of the invention to provide an improved socket contact and a method for producing the same, which fulfills the smaller pitch requirement imposed upon connectors having recently become stronger, and which is easy to assemble and can obtain stable contact with a mating contact, as a result of prevention of the distal end of the mating contact from contacting the bottom surface of the fixing portion of the socket contact.

In a socket contact to be held and fixed in an insulator, including a connection portion to be connected to a board, a fixing portion to be fixed to the insulator, contact portions to contact a mating contact and connecting portions for connecting the contact portions to said fixing portion, these being arranged in the order of the contact portions, connecting portions, fixing portion and connection portion, in order to accomplish the above object, according to the invention the center axis of the contact portions in the inserting direction of the mating contact is shifted from the fixing portion by bending the connecting portions in their planes.

A method for producing a socket contact according to the invention comprises three steps carried out in the order of first, second and third steps, wherein in the first step a metal plate strip is punched to form a flat socket contact, in the second step two contact pieces of the socket contact punched from the blank plate strip, which are arranged in parallel with each other, are bent inwardly to form a U-shaped form, and in the third step connecting portions of the two contact pieces arranged in parallel with each other are bent in the planes of the connecting portions.

According to the invention the center axis of the contact portions 18 of the socket contact is shifted by 0.1 to 0.4 mm from the bottom surface of the fixing portion. If the value is less than 0.1 mm, there will be risk of the distal end of a mating contact contacting bottom surface of the fixing portion of the socket contact in view of the diameter and workability of the mating contact. If it is more than 0.4 mm, the height of the socket contact increases which will oppose to the miniaturization requirement of connectors which has recently become stronger. Consequently, the shifted value between the center axes of the contact portions and fixing portion is appropriately designed in consideration of the workability and strength of a mating contact 22 and the miniaturization of the connector.

The inclined angle of the parts of the connecting portions relative to the center axis of the contact portions is within a range of 3 to 20 degrees. With the inclined angle less than 3 degrees, the length of the contact as an elastic body becomes longer to weaken the contacting force between the socket contact and a mating contact and to make larger the connector. With the inclined angle more than 20 degrees, cracks will occur in the socket contact in bending process. Consequently, the inclined angle between the contact portions and connecting portions is appropriately designed in consideration of the shifted value between the center axes of the contact portions 18 and fixing portion 16, the workability and strength of a mating contact 22 and the miniaturization of the connector.

The socket contact comprising the above features according to the invention has the following significant effects.

According to the invention, the center axis of the contact portions 18 is shifted from the bottom surface 15 of the fixing portion 16 by a distance corresponding to the radius of the mating contact 22 plus clearance between the distal end of the mating contact and the bottom surface 15 of the fixing portion 16. Therefore, there is no risk of the contact of the distal end of the mating contact 22 with the bottom surface 15 of the fixing portion 16 when both the contacts are connected, thereby eliminating any damage of the male and female contacts to obtain the stable contact therebetween even in miniaturized socket contacts.

The parts of the connecting portions 20 inclined to the contact portions 18 only at an angle of 3 to 20 degrees enable the center axis of the contact portions 18 to shift from the bottom surface 15 of the fixing portion 16 by the distance corresponding to the radius of the mating contact plus the desired clearance. This feature will facilitate the working of the socket contact according to the invention.

The shifting of the contact portions from the fixing portions 16 by bending of the connecting portions in the direction of the height of the socket contact makes it possible to set the pitch of socket contacts less than 2 mm. Therefore, the electrical connector 1 using the socket contacts 10 according to the invention can also be more miniaturized.

As the pitch of a series of the continuous socket contacts just after a metal plate strip has been punched according to the invention can be arranged at a pitch less than 2 mm, these continuous socket contacts 10 can be inserted into the insulator at the same time in assembling the electrical connector so that the electrical connector using the socket contacts according to the invention can be easily assembled without increasing the manufacturing cost.

The invention will be more fully understood by referring to the following detailed specification and claims taken in connection with the appended drawings.

DESCRIPTION OF THE PREFERRED EMBODIMENTS

Figure 1A:
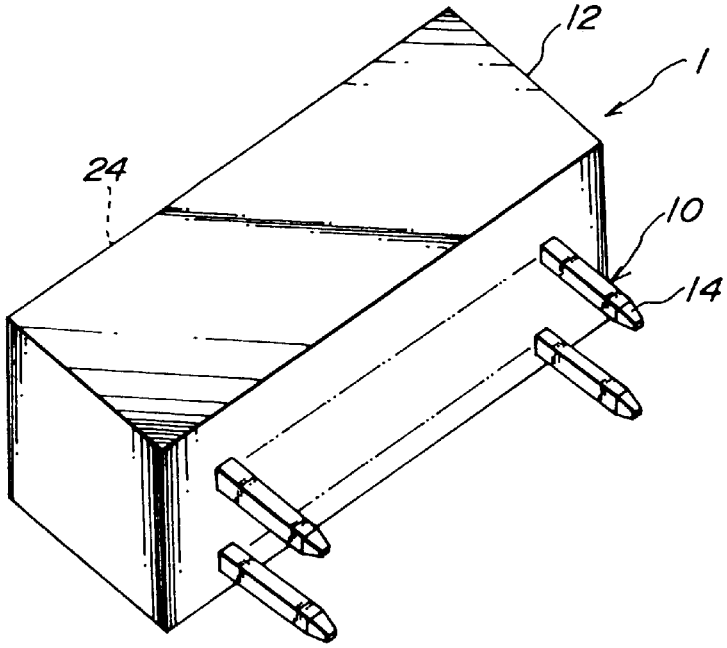
FIG. 1A is a perspective view of an electrical connector using the socket contacts according to the invention.
Figure 1B:
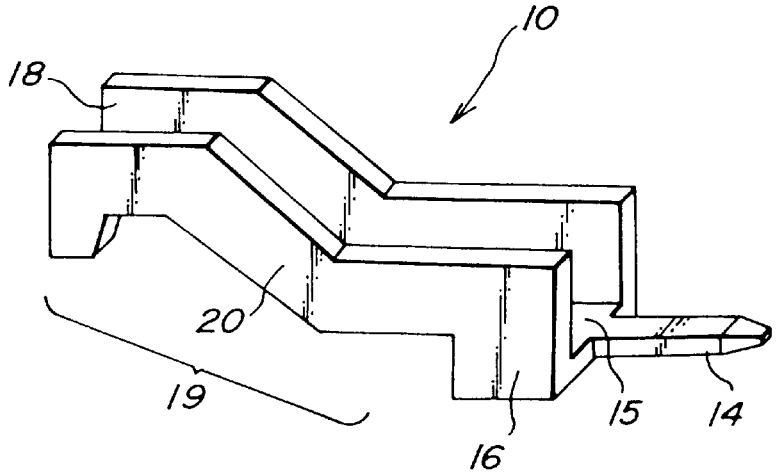
FIG. 1B is a perspective view of the socket contact according to the invention.
Figure 2A:
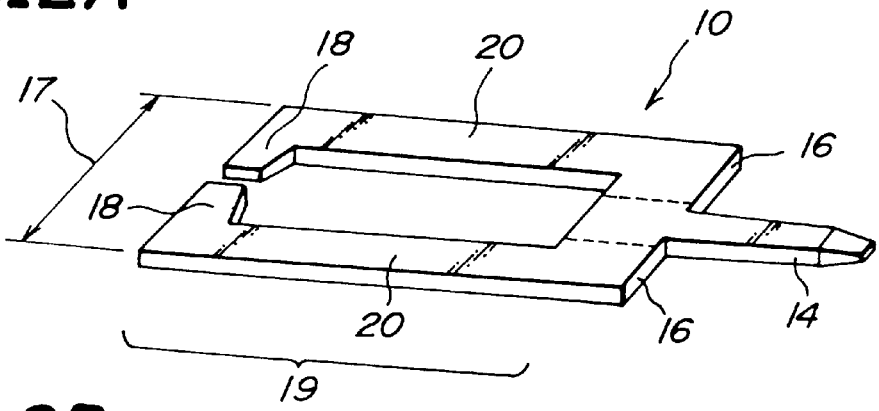
FIG. 2A is a perspective view of the socket contact according to the invention immediately after punched from a metal plate strip.
Figure 2B:
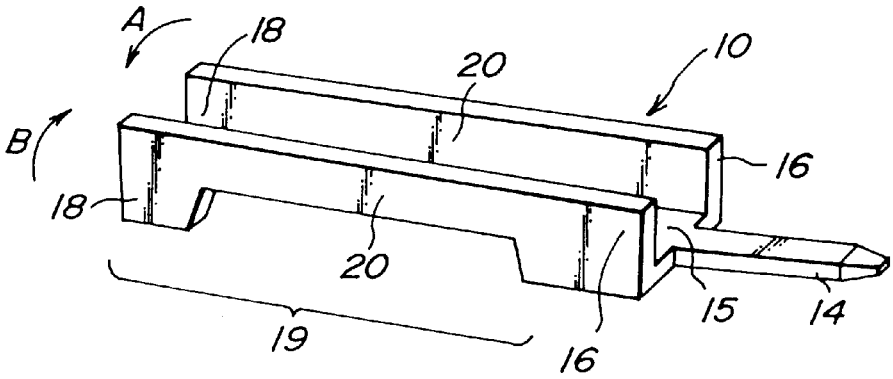
FIG. 2B is a perspective view of the socket contact according to the invention whose contact pieces have been bent into a U-shaped form.
Figure 2C:
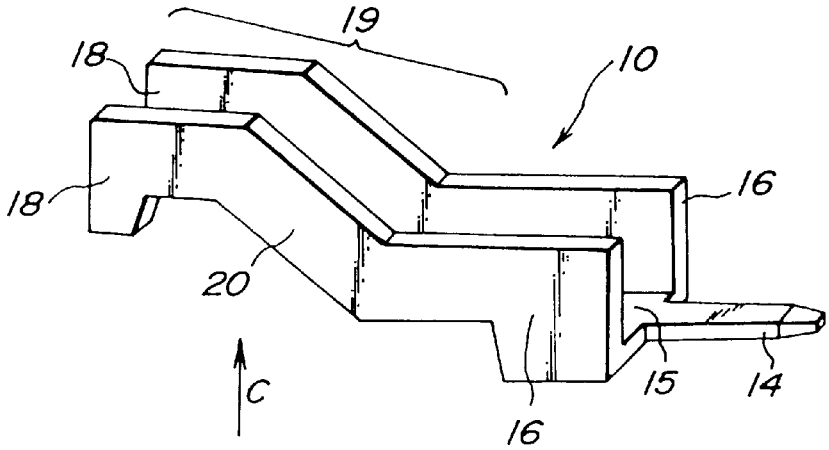
FIG. 2C is a perspective view of the finally completed socket contact according to the invention.
Figure 3:
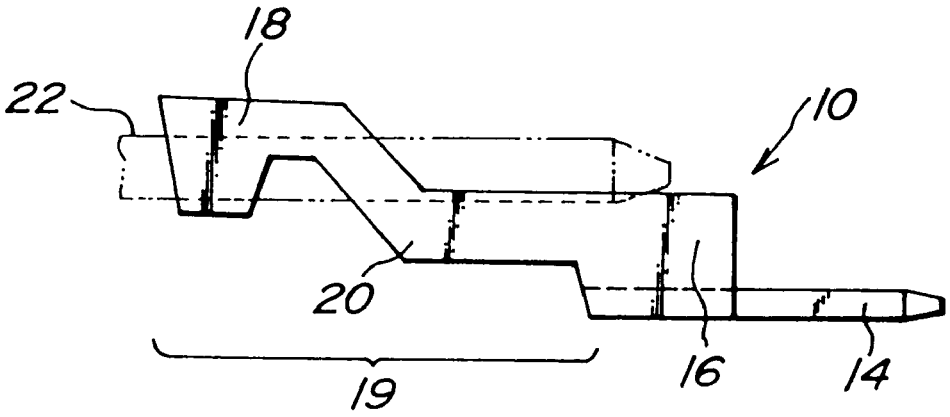
FIG. 3 is a side view of a socket contact according to the invention with a mating contact inserted therein.
Figure 4A:
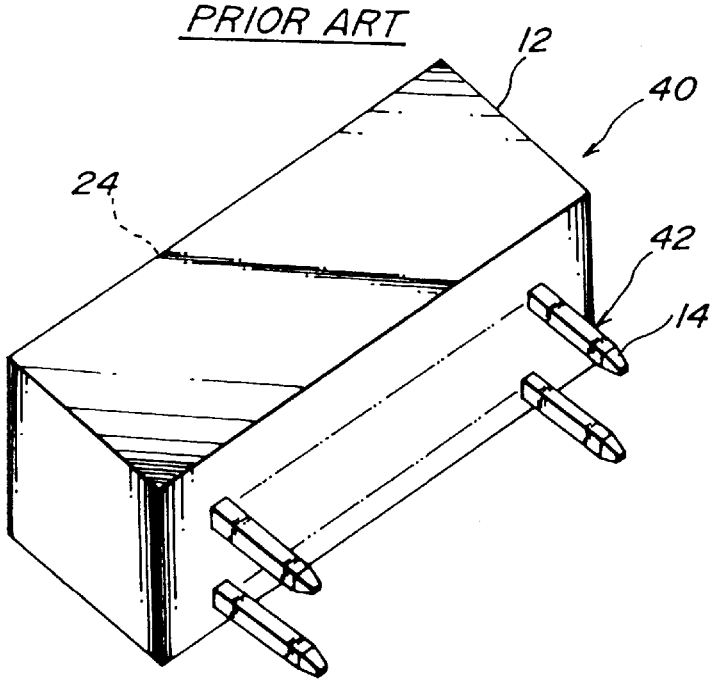
FIG 4A PRIOR ART
FIG. 4A is a perspective view of an electrical connector using socket contacts of the prior art.
Figure 4B:
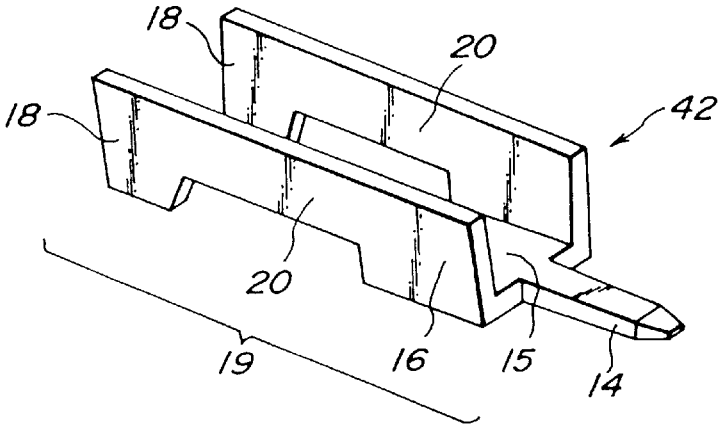
FIG 4B PRIOR ART
FIG. 4B is a perspective view of the socket contact of the prior art.
Figure 5A:
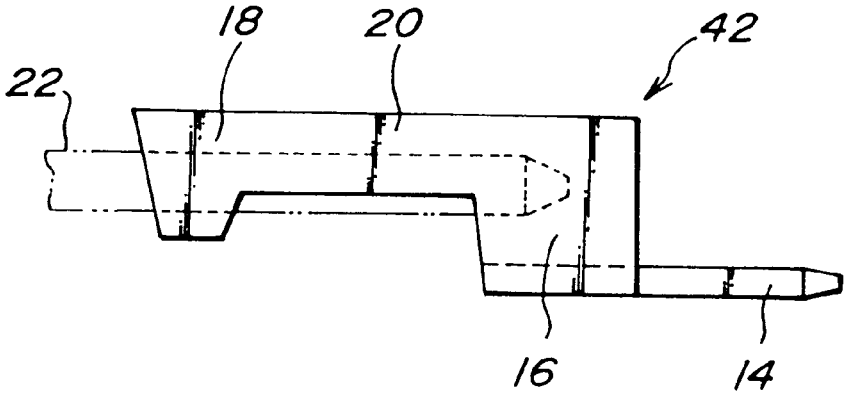
FIG 5A PRIOR ART
FIG. 5A is a side view of the socket contact of the prior art with a mating contact inserted therein.
Figure 5B:
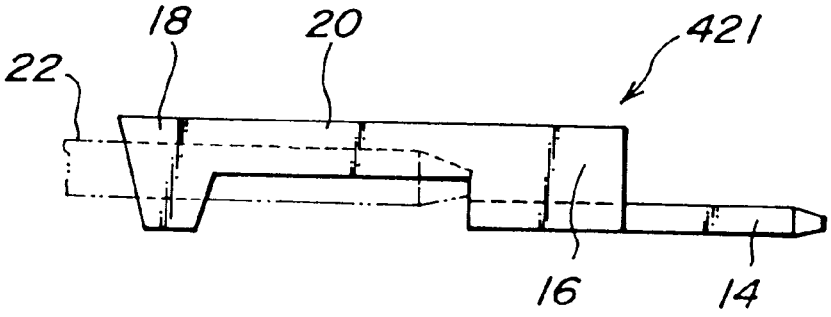
FIG 5B PRIOR ART
FIG. 5B is a side view of a socket contact of the prior art modified to have a narrower pitch and a mating contact inserted therein.

FIG. 1A schematically illustrates in a perspective view an electrical connector 1 using the socket contacts 10 according to the invention, whereas FIG. 1B illustrates in a perspective view the socket contact 10 according to the invention. FIG. 2A shows in a perspective view the socket contact 10 just punched from a blank strip and FIG. 2B in a perspective view the socket contact whose portions except its connection portion 14 have been formed into a U-shape by bending. FIG. 2C illustrates the completed socket contact according to the invention. FIG. 3 is a side view of the socket contact 10 according to the invention and a mating contact 22 inserted therein.

In general, an electrical connector 1 is mainly constructed by socket contacts 10 and an electrical insulator 12. The electrical connector 1 has a size over a wide range. The electrical connector 1 in the shown embodiment has a length of the order of 50 mm, a width of 15 mm and a height of 12 mm. This length varies depending on the pitch and the number of contacts. In the shown embodiment, the pitch of contacts is 2 mm and the number of contacts is 125. However, the pitch may vary from 1.5 mm to 2.5 mm and the number of contacts from 50 to 150, depending on the desired function and the like of the connector.

While the contact tail of the straight dip type is shown in the embodiment, it will be apparent that any other types may be used such as L-shaped dip type or surface mounting type (referred to hereinafter as "SMT").

First, the socket contact 10 according to the invention will be explained. The socket contact 10 comprises four portions, that is, a connection portion 14 to be connected to a board (not shown), a fixing portion 16 to be fixed to the insulator 12, contact portions 18 adapted to contact a mating contact 22 of a mating connector (not shown) and connecting portions 20 for connecting the contact portions 18 to the fixing portion 16 in the manner similar to the prior art socket contact. These portions are arranged in the order similar to that of prior art socket contact. Moreover, the contact portions 18, connecting portions 20 and fixing portion 16 are referred to as contact pieces 19 as in the prior art socket contact.

The socket contact 10 is formed in the known processes such as press-forming and then held and fixed in the insulator 12. The materials which can be used in the socket contact 10 are phosphor bronze and beryllium copper which are superior in springiness. For the economic reason and in view of good workability, the phosphor bronze is better. This socket contact 10 has a length of 7 mm, a width of 1.2 mm and a height of 1 mm.

Respective components of the socket contact 10 will be explained hereinafter. First, the contact piece 19 including the contact portion 18 and the connecting portion 20 will be explained. The free end of the contact piece 19 is provided with the contact portion 18 and the opposite end is connected to the fixing portion 16.

The original flat fixing portion 16 has been inwardly bent substantially at right angles along two lines into a substantially U-shaped form so that two contact pieces 19 are arranged in parallel with each other so as to face to each other. The distance between the two contact pieces 19 thus formed by bending is appropriately designed in consideration of the contact pressure with a mating contact 22 and the contact stability and the miniaturization of connectors.

The contact portions 18 at the free ends of the contact pieces 19 are adapted to contact the mating contact 22 as shown in FIG. 3. The contact portions 18 may have any shape so long as it can contact the mating contact 22. However, as the mating contact 22 is inserted into the socket contact 10 over a considerably long distance therein, preferably the contact portions 18 are curved inwardly to prevent the mating contact 22 from contacting any portions other than the contact portions 18, to mitigate the wears of the socket contact 10 itself and mating contact 22 and, in addition, to facilitate to guide the mating contact 22.

Instead of curving the contact portions 18, these portions may be provided on their inwardly facing surfaces with inwardly extending protrusions or may be formed with a widely spread opening to facilitate the insertion of the mating contact 22.

The width 17 of the contact piece 19 in a flat state as shown in FIG. 2A is appropriately designed in consideration of the strength and the contact stability with the mating contact 22. As the width 17 affects the narrow pitch of the electrical connector 1, it is determined as narrow as possible. In the shown embodiment, it is 2 mm.

Then, the connecting portion 20 will be explained. The connecting portions 20 are positioned between the contact portions 18 and the fixing portion 16. The connecting portions 20 are worked by bending so that the contact portions 18 are shifted away from the fixing portion 16 in order to prevent the inserted mating contact 18 from contacting the fixing portion of the socket contact as shown in FIG. 2C and 3.

The connecting portions 20 are substantially in the form of a crank in an exaggerated expression. The angle between the inclined portions of the connecting portions 16 and the fixing portion 16 is appropriately designed in consideration of prevention of the distal end of the mating contact 22 from contacting the bottom 15 of the U-shaped fixing portion 16 and the workability and strength of the socket contact 10. In the shown embodiment, this angle is within a range of 3 to 20 degrees.

The connecting portion 20 has the inclined portion oblique to the fixing portion 16 depending upon the diameter of the mating contact 22 so that the distance between the center axis of the contact portions 18 and the bottom surface 15 of the U-shaped fixing portion 16 corresponds to the radius of the mating contact 22 plus desired clearance. The connecting portion 20 may have any shape and size so long as it fulfills the requirements described above.

The fixing portion 16 of the socket contact 10 is provided with an interference for press-fitting or lances and the like for fixing the socket contact to the insulator 12 by press-fitting or biting (with the lances). The fixing portion may have any shape so long as the socket contact 10 can be fixed to the insulator 12.

The connection portion 14 of the socket contact 10 is the portion to be connected to a board or the like (not shown). Although the connecting portion of the straight dip type is shown in this embodiment, it is to be understood that any other types may be used such as L-shaped dip type or surface mounting type (SMT).

The insulator 12 is made of an electrically insulating plastic material for holding and fixing the socket contacts therein and formed by the known molding technique. Examples of such a material of the insulator 12 are PBT, 66PA, 46PA, PET, LCP, PPS and the like. For the economic reason and in view of good workability, the PBT is better.

The insulator 12 is formed with apertures (not shown) into which the socket contacts 10 are inserted and fitting opening 24 into which mating contacts are inserted.

Finally, the method for producing the socket contact 10 will be explained by referring to FIGS. 2A to 2C.

In the first step, a metal plate strip is punched to form the socket contacts 1 in a flat state as shown in FIG. 2A.

In the second step, the socket contact 10 punched from the blank material is then subjected to bending along two lines shown in broken lines in FIG. 2A to form the U-shaped fixing portion 16 so that the contact pieces 19 are arranged in parallel with each other. In more detail, one of the contact pieces 19 is bent in the direction shown by an arrow A and the other contact piece 19 is bent in the direction shown by an arrow B to form the U-shaped contact pieces viewed from the connection portion 14.

In the third step, the two connecting portions 20 of the contact pieces 19 arranged in parallel with each other are bent in the direction shown by an arrow C so that the center axis of the contact portions 8 is shifted away from the bottom surface 15 of the U-shaped fixing portion 16.

The first, second and third steps described above are successively carried out to produce the socket contact according to the invention.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A socket contact formed by bending from a planar metal blank and adapted to be held and fixed in an insulator, including at one end a connection portion adapted to be connected to a board and lying in a first plane, wherein the first plane is a plane parallel to the metal blank, a generally U-shaped fixing portion adjacent the connection portion having a base part lying in the first plane and side parts bent perpendicularly to the first plane so as to lie in spaced-apart parallel second planes perpendicular to the first plane and adapted to be fixed to said insulator, a pair of contact portions at the other end of the socket contact lying in the second planes and adapted to contact a mating contact, and a pair of connecting portions lying in the second planes and connecting said contact portions to the side portions of said fixing portion, wherein a center axis of said contact portions in an inserting direction of said mating contact is offset from the first plane by bending said connecting portions in the second planes such that the connecting portions extend obliquely to the center axis.

2. The socket contact as set forth in claim 1, wherein said center axis of said contact portions is shifted from the fixing portion by 0.1 to 0.4 mm.

3. The socket contact as set forth in claim 1, wherein parts of said connecting portions are inclined to the center line of said contact portions at an angle of 3 to 20 degrees.

* * * * *